United States Patent [19]

Simm et al.

[11] 4,098,471

[45] Jul. 4, 1978

[54] APPARATUS FOR SEVERING A CONTINUOUS CLOTH WEB MOUNTED ON A ROLLER

[75] Inventors: Hans Peter Simm; Gerhard Voswinckel, both of Aachen, Germany

[73] Assignee: Fa. H. Krantz GmbH & Co., Aachen, Germany

[21] Appl. No.: 773,747

[22] Filed: Mar. 2, 1977

[30] Foreign Application Priority Data

Mar. 10, 1976 [DE] Fed. Rep. of Germany ... 760720[U]

[51] Int. Cl.[2] ..... B65H 19/20

[52] U.S. Cl. ..... 242/56 R

[58] Field of Search ..... 242/56 R; 83/56, 321, 83/341, 329, 848, 849, 855

[56] References Cited

U.S. PATENT DOCUMENTS

| | | | |
|---|---|---|---|
| 2,175,102 | 10/1939 | Beck | 242/56 R |
| 2,427,611 | 9/1947 | Lane | 242/56 R |
| 2,830,775 | 4/1958 | Kiesel | 242/56 R |
| 3,323,739 | 6/1967 | Deming | 242/56 R |
| 3,556,424 | 1/1971 | Catallo | 242/56 R |
| 3,592,403 | 7/1971 | Schmitt | 242/56 R |

*Primary Examiner*—Edward J. McCarthy
*Attorney, Agent, or Firm*—Arthur B. Colvin

[57] ABSTRACT

The invention relates to an apparatus for cutting through a continuous cloth web mounted on a supply roller with the free end of the web being collected on a takeup roller and includes a beam, carrying cutting blades movable transversely across the span of the cloth web stretched between the rollers, an auxiliary takeup roller being provided between the supply roller and the cutting blades to receive the associated severed end of the web.

6 Claims, 4 Drawing Figures

APPARATUS FOR SEVERING A CONTINUOUS CLOTH WEB MOUNTED ON A ROLLER

As conducive to an understanding of the invention, it is noted that where a cutting knife is employed that moves perpendicularly against a cloth web extending as a span between a supply roller and a takeup roller to cut the web to form rolls of web containing predetermined lengths of cloth from a much longer length of cloth carried by the supply roller, depending upon the strength of the cloth web to be severed, the web span must be maintained under relatively great tautness during the cutting action.

If the span of web is insufficiently tensioned at the region of the cut, the cutting knife impinging perpendicularly against the cloth web, may merely move to the end position of the stroke of the knife without cutting through the web or the cutting action may take too long with result that if the web is continually advancing, the cut edge of the web will be irregular.

As it is often undesirable to keep the moving cloth web under high tension continuously, particularly where delicate fabrics are involved which may stretch excessively, an abutment may be employed for the knife which involves stoppage of the web during the cutting operation with the resultant delay in the process.

It is among the objects of the invention to provide an apparatus for the cutting of a continuous cloth web which does not require the web to be maintained under a high tension in order to provide a clean uniform cut, and which does not require the web to be stopped during the cutting action.

According to the invention these objects are accomplished by the arrangement and combination of elements hereinafter described and more particularly recited in the claims.

In the accompanying drawings in which are shown one of various possible embodiments of the several features of the invention:

Figure 1:
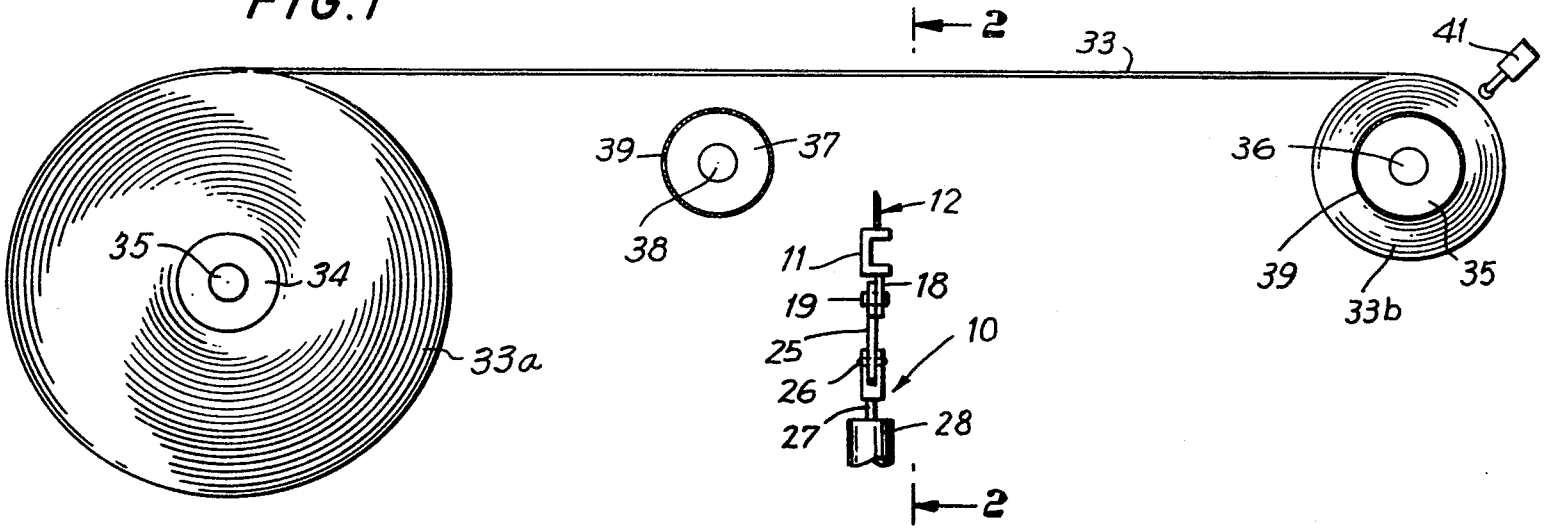
FIG. 1 is a side elevational view of the apparatus showing the supply roller, the takeup rollers and the cutting apparatus with parts broken away.
Figure 2:
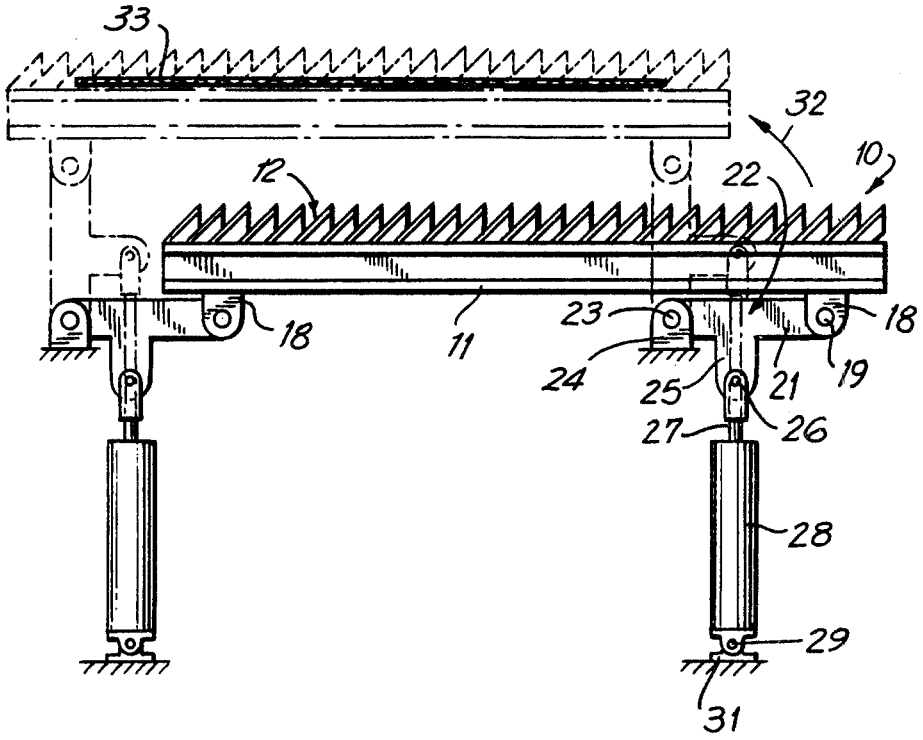
FIG. 2 is an elevational view of the cutting apparatus taken along line 2—2 of FIG. 1, showing the same in retracted position in full lines and in extended operating position in broken lines.
Figure 3:
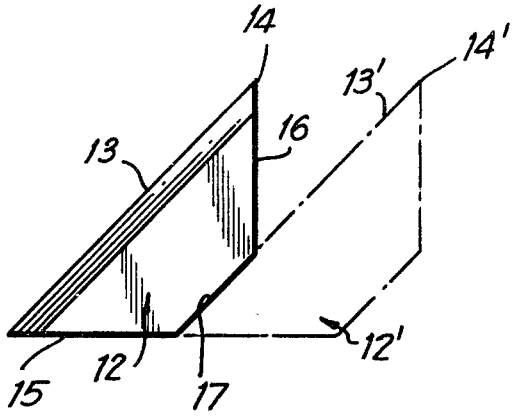
FIG. 3 is a side elevational view of a knife blade.

Referring now to the drawings, as shown in FIGS. 1 and 2, the cutting apparatus 10 comprises an elongated rigid beam 11 on the upper surface of which is mounted a plurality of knife blades 12 each in the form of a trapezoid.

The longer leg 13 of the trapezoid is formed as a cutting edge terminating at one end in a sharp point 14. Extending from the other end of leg 13 is the base leg 15 which is secured to the beam 11 so that the leg 16 opposed to leg 15 depends vertically from point 14. The short leg 17 which extends parallel to leg 13 defines an abutment for the leg 13' of the next adjacent blade 12'.

The juxtaposed blades 12 arranged on the beam 11 as above described, have their sharp points 14 in the same horizontal plane and the cutting edges 13 thereof extend at an angle from the horizontal. Thus, the plurality of blades 12 arranged as above described define substantially a saw-toothed cutting edge.

The beam 11 has a depending lug 18 near each end thereof, to each of which is pivotally connected as at 19 one end of the cross leg 21 of a T-shaped crank 22, the other end of leg 21 being pivotally connected as at 23 to a fixed mount 24. The end of the depending leg 25 of each of the cranks 22, which is perpendicular to cross leg 21, is pivotally connected as at 26 to the end of the piston rod 27 of an associated actuator 28, the end of the latter being pivotally connected as at 29 to a fixed support 31.

With the arrangement above described, a parallelogram linkage is provided so that when the actuators 28 are energized to extend the piston rods 27 thereof, the beam 11 will be moved from the retracted position shown in full lines in FIG. 2 to the extended or operating position shown in broken lines in FIG. 2. The beam will always be maintained in horizontal position through its arcuate path of movement from right to left as shown by the arrow 32.

As shown in FIG. 2, which illustrates the beam 11 in retracted position, the cutting assembly is located beneath the cloth web 33 to be severed and preferably is of operative width greater than the width of the web to be severed.

More particularly, a supply roller 34 carrying a continuous length of cloth web 33*a* which is to be severed is mounted on a horizontal shaft 35 in manner so that the roller 34 can rotate freely.

The web 33 extends to a takeup or storage roller 35 which is mounted on a horizontal driven shaft 36 and on which the web 33 collects as shown at 33*b*.

Interposed between the cutting apparatus 10 and the supply roller 34 is an auxiliary takeup roller 37 also mounted on a driven shaft 38, the surface of roller 37 having secured thereto a strip of glue or adhesive tape 39 which will be engaged by the web 33 after it is severed in the manner to be dedescribed, to collect the web 33 thereon.

In operation of the apparatus, the free end of the web 33 is first connected to the strip of glue or adhesive tape 39 secured to the surface of takeup roller 35.

With the beam 11 in retracted position shown in full lines in FIG. 2, as well as in FIG. 1, the shaft 36 is energized so that the web 33 is drawn from the supply roller 34 and will collect on the takeup roller 35 as shown at 33*b*.

After a predetermined length of web has collected on the takeup roller 35, which may be determined by the setting of a suitable conventional counter unit controlled by the number of revolutions of shaft 36 or by a microswitch 41 actuated when the collected web 33*b* obtains the desired diameter, the actuators 28 are energized.

As a result, the beam 11 will, as a result of the parallelogram linkage, move in an arcuate path as illustrated by the arrow 32 while still maintaining its horizontal position.

Figure 4:
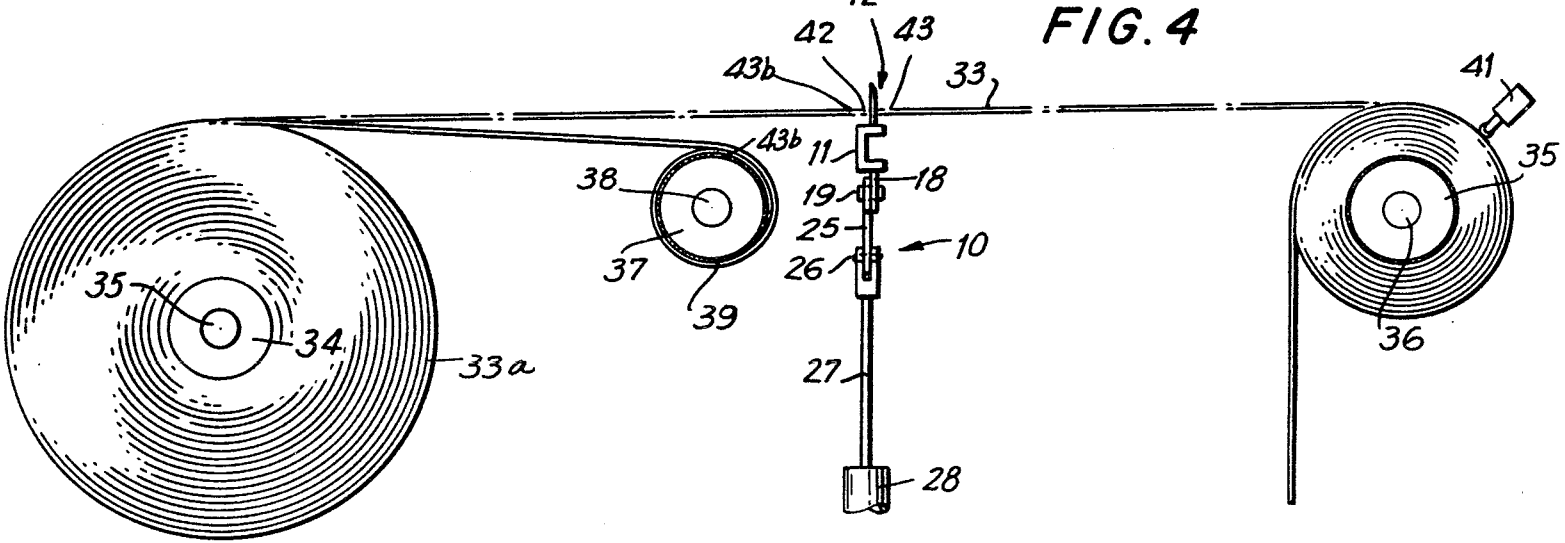
FIG. 4 is a view similar to FIG. 1 illustrating the apparatus after the cutting operation has been performed.

As the beam 11 moves upwardly and to the left, referring to FIG. 2, from the full line position shown in FIGS. 1 and 2 to the broken line position shown in FIG. 2 and also in FIG. 4, the knife blades 12 will move transversely across the relatively taut span of web 33 between supply roller 34 and takeup roller 35. Such movement of the knife blades is relatively rapid. When the sharp points 14 of the blades 12 first contact the web, due to the upward movement of the blades the points 14 will first pierce the web and with combined upward and transverse movement of the blades, they will immediately sever the web as at 42 and the severed end portion 43 of the web 33 will be drawn around the takeup roller 35.

At the same time, the severed end portion **43*b* of the web will fall on the surface of the auxiliary takeup roller 37 and by reason of the glue or adhesive strip 39 thereon, will adhere thereto. As the roller 37 is being rotated by the driven shaft 38, the web 33 will start to collect on the auxiliary takeup roller 37**.

After a short period sufficient to enable a few convolutions of the cloth web 33 to collect on the roller 37, the control system will cause the actuators 28 to be retracted and will stop rotation of rollers 35 and 37.

Thereupon, the cloth web **33*b* collected on roller 35, which is of desired length, is removed from shaft 36 and the roller 37 with the few convolutions of cloth web thereon is removed from shaft 38 and positioned on shaft 36 so that a span of web 33 again extends over the retracted cutting apparatus 10. A new auxiliary takeup roller 37 is then mounted on shaft 38** and the apparatus is ready for the next cloth severing cycle.

By reason of the parallel linkage employed and the unique arrangement of the cutting blades whereby the sharp points thereof first pierce the cloth web to serve as a lead for the cutting edge of the associated blade and by reason of the high rate of speed of the movement of the knife carrying beam, the cloth web may be severed without need to stop the latter. Furthermore, the cloth web does not have to be maintained under any great tension as the sharp points of the blades will pierce the web even if it is under slight tension thereby insuring a uniform cut.

Having thus described our invention, what we claim as new and desire to secure by Letters Patent of the United States is:

1. Apparatus for cutting through a cloth web stretched between a supply roller and a takeup roller, each of said rollers being mounted on parallel shafts, comprising an elongated cutting member of length at least equal to the width of said web and means to move the cutting member against and transversely across the width of the web to sever the latter, said means comprising a parallelogram linkage in which said elongated cutting member includes a beam comprising one leg of said linkage, a pair of crank arms are provided each having a fixed pivotal mount at one end and being pivotally mounted at their other ends to the beam and means simultaneously to pivot said crank arms to effect simultaneous transverse and vertical movement of said beam.

2. The combination set forth in claim 1 in which a pair of actuators are provided, means pivotally mounting one end of each of the actuators to a fixed support, each of the actuators having a piston rod pivotally connected to an associated crank arm to pivot the latter.

3. The combination set forth in claim 1 in which said cutting member comprises an elongated beam, a plurality of knife blades are mounted on said beam and extend upwardly therefrom, said plurality of blades defining a saw-toothed cutting edge.

4. The combination set forth in claim 1 in which said cutting member comprises an elongated beam, a plurality of knife blades are provided rising from said beam, each in the form of a trapezoid, one of the legs of each of said blades defining a base secured to said beam, the longer leg of said blade defining the cutting edge, the junction between said longer leg and the leg opposed to said base leg defining a sharp upwardly extending point, said blades all extending longitudinally along said beam in substantially the same plane with the lower portion of the cutting edge of a subsequent blade abutting against the leg of the preceding blade opposed to the cutting edge of said preceding blade, said cutting edge facing the direction of transverse movement of the cutting member to sever the web.

5. The combination set forth in claim 1 in which an auxiliary takeup roller is interposed between said supply roller and said cutting member on an axis parallel to the axis of said supply roll and means on said auxiliary takeup roller to retain the severed end of said web thereagainst.

6. The combination set forth in claim 5 in which said takeup roller and said auxiliary takeup roller are positively driven.

* * * * *